US006168016B1

(12) United States Patent
Lawson

(10) Patent No.: US 6,168,016 B1
(45) Date of Patent: Jan. 2, 2001

(54) ORGANIZER BAG FOR TRANSPORTING BASEBALL SOFTBALL EQUIPMENT ON A GOLF CART

(76) Inventor: Ronald G. Lawson, 14090 Elvira St., Saratoga, CA (US) 95070

( * ) Notice: Under 35 U.S.C. 154(b), the term of this patent shall be extended for 0 days.

(21) Appl. No.: 09/121,715

(22) Filed: Jul. 22, 1998

(51) Int. Cl.[7] ..... A63B 55/00

(52) U.S. Cl. ..... 206/315.1; 206/315.5; 206/315.7; 206/315.8; 206/315.9; 224/245

(58) Field of Search ..... 206/315.1, 315.6, 206/315.7, 315.3, 315.8, 315.9; 224/245

(56) References Cited

U.S. PATENT DOCUMENTS

| | | | | |
|---|---|---|---|---|
| 4,463,789 | * | 8/1984 | Leiseron | 224/245 |
| 4,509,643 | * | 4/1985 | Rhee | 206/315.8 |
| 4,793,532 | * | 12/1988 | Cash | 206/315.1 |
| 4,968,048 | * | 11/1990 | Lortie | 206/315.1 |
| 5,123,531 | | 6/1992 | Berretta | 206/315.3 |
| 5,356,002 | | 10/1994 | Brown | 206/315.1 |
| 5,588,529 | | 12/1996 | Spack | 206/315.1 |
| 5,605,310 | * | 2/1997 | Jungkind | 206/315.7 |
| 5,765,712 | * | 6/1998 | Skinner et al. | 220/740 |
| 5,860,519 | * | 1/1999 | Meyer et al. | 206/315.1 |

* cited by examiner

*Primary Examiner*—Joseph M. Moy
(74) *Attorney, Agent, or Firm*—Robert S. Smith

(57) ABSTRACT

A utility bag for storing equipment for a baseball/softball team. The bag is constructed to be strapped to and transported on a golf cart. The bag includes a bag having a collar at an open end and a cap enclosing a lower end . The collar at the upper end has a recessed shoulder enabling the collar to engage the lip of a bucket of balls so that balls are retained in the bucket when a lid is positioned down onto the collar. A frame inside the utility bag retains the utility bag in an open configuration. A bat bag for storing bats is detachably attached to the outside surface of the bag. The inside of the bag is dimensioned for storing a collection of helmets and catchers gear as well as one or more pouches for storing catcher's shinguards.

16 Claims, 1 Drawing Sheet

ORGANIZER BAG FOR TRANSPORTING BASEBALL SOFTBALL EQUIPMENT ON A GOLF CART

FIELD OF THE INVENTION

This invention relates to bags for transporting athletic equipment and particularly to a bag organized to contain equipment for baseball and softball teams. that can be transported on a golf cart.

Every baseball or softball team utilizes a sizable collection of balls, helmets, catchers propective gear, bats and gloves. It is frequently necessary to gather up all of this equipment and transport it between the field and a storage area. A typical situation is where a coach carries all of the team equipment in the trunk of his car or station wagon to a school parking lot from whence he must lug it to the athletic field Many teams practise on a school athletic field located a quarter mile or more from the parking facility so that carrying all of this equipment is very tiresome.

Bags for carrying baseball/soft ball sport utility equipment have been disclosed.

For example, U.S. Pat. No. 5,356,002 to Brown discloses a utility bag with an elongated chamber for carrying the bats.

U.S. Pat. No. 5,588.529 to Spack also discloses a bag with an elongated chamber for storing bats and a removable shelf.

Neither of these disclosures consider the problem of storing helmets or catchers gear.

Another situation that occurs during practice the requirement to move a collection of balls from one part of the field to another, such as from the dugout to the pitchers mound or to a pitching machine. A systematic arrangement for keeping track of the balls and being able to transport them as a group from one location to another is not only a convenience but also tends to keep the balls from being scattered or lost.

Other sports have a related problem of transporting and accounting for equipment needed by the team.

Golfers have solved their problem by developing a bag that may be mounted on a golf bag hand-pulled cart. For example, U.S. Pat. No. 5,123,531 to Beretta discloses a golf club bag configured for use on a golf cart having a tubular main body with a base at the lower end and a cuff at the upper end. Separators extend across the cuff which define partitioning areas across the opening at the cuff so that each partition area may receive a specific club thereby enabling the player to withdraw more conveniently a desired club from the bag. An added bag compartment with zippered opening, is secured to the outside surface of the bag for storing golf balls. Hand pulled golf carts have been developed for transporting these bags, filled with clubs, on the golf course.

This golf bag and other similar golf bags in use for many years would not be suitable for carrying baseball equipment for many reasons without making very substantial changes which are not suggested by the prior art.

SUMMARY

It is an object of this invention to provide a bag for organizing and transporting baseball/softball equipment using a golf cart.

It is another object to compartmentalize the bag so that each type of item is separated from other types of items thereby making it more convenient to account for all the items of each type and to withdraw a required item from the bag. In particular, it is an object to store the balls as a group, the helmets as a group and the bats as group in a manner that each group can be separate from each of the other groups.

This invention is directed toward a bag for transporting base ball/soft ball equipment which has a generally tubular construction of flexible material such as canvas. Several metal or plastic rods extend between opposite ends of the tube and are attached to the inner surface of the bag so that the bag is "free standing".

The top open end of the tube has a stiffening collar of lexan or similar that supports the upper end of the tube in an open configuration. The collar has a circumferential inner shoulder that supports the lip of a bucket for holding a plurality of baseballs or softballs. The storage region for the balls is thereby separated from the lower, larger region of the bag where helmets and catchers gear are stored.

A lid has an edge hingably attached to one side of the open top end of the tube so that, to contain the bucket of balls inside the bag the lid is rotated about the hinge and fitted down over the collar at the open end of the tube where it is secured by a VELCRO™ strap. The hinge is preferably a strap having one end sewn to the collar and the end sewn to the lid.

The bottom end of the tube is enclosed in a reinforcing cap section which also anchors the bottom ends of the reinforcing rods.

The cap and collar sections are made of a "yielding" material such as lexan plastic so that these two sections are stiffer than the canvas tubular section. The lexan surfaces are preferably covered by a decorative material such as fabric.

Several pockets are provided around the outside of the bag. Each pocket may be closable by a flap securable over the top opening of the respective pocket by a hook and eye material such as VELCRO™. Alternatively, one or more of the pockets may be closable by vertically extending zippers.

A mesh bag 31 for holding bats is shown having a number of attachments 29 (e.g., two "S" hooks ) arranged peripherally around the bat bag near the upper end of the bag, which are detachably attachable to "D" rings on the bat bag. The lower end of the bat bag may be secured by a single elastomeric strap (bungee cord) that wraps across the bat bag and engages the golf cart.

A handle is attached to the outside surface of the bag configured to permit carrying the bag. The bag for baseball/softball equipment may also be strapped to a golf cart for transportation or stored in the trunk of most vehicles.

DESCRIPTION OF AN ILLUSTRATIVE EMBODIMENT

Figure 1:
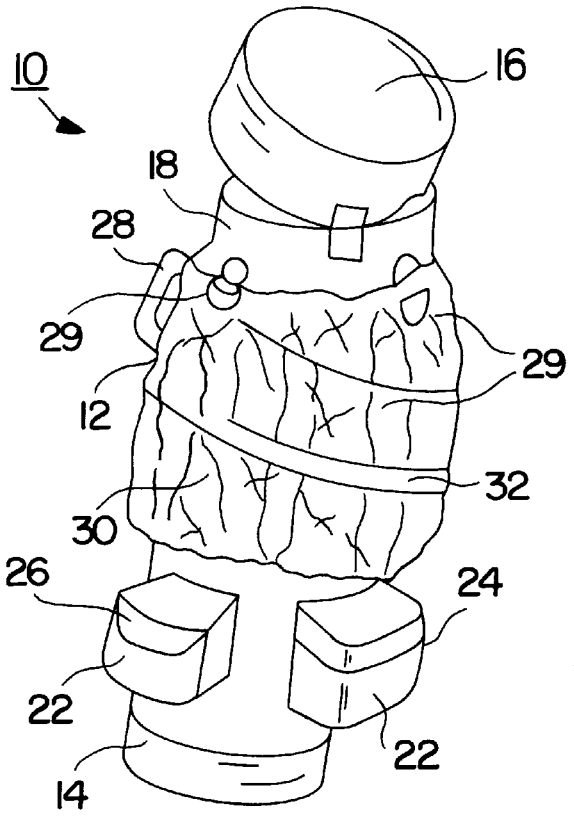
FIG. 1 is a perspective view of the utility bag of this invention.

Turning now to a description of the drawings, FIG. 1 is a perspective view of the bag 10 for base/soft ball equipment of this invention which includes a generally elongated canvas tubular section 12 having at one end an attached cap section 14 and at another end a top collar section 18 that mates with a lid 16.

Figure 2:
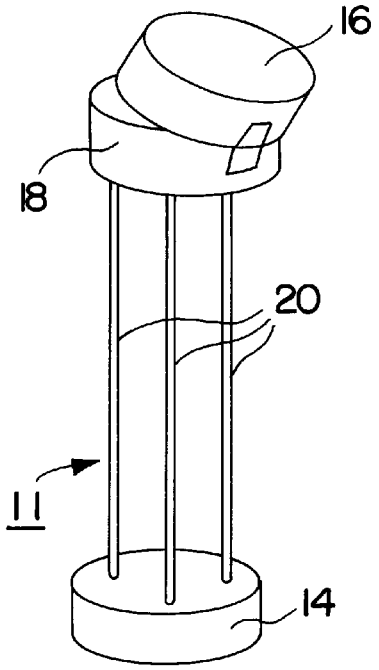
FIG. 2 shows the frame inserted into the interior of the bag.

FIG. 2 is an exploded view showing a frame 11 comprising three rods 20 whose ends are secured to the collar section 18 and and cap section 14. The rods 20 are preferably made of metal or plastic rod, ¼ diameter. Both top and bottom sections, 14 and 18, are preferably made of a "yieldingly stiff" material such as lexan (¼ inch thick) although they could be made of metal. These sections are covered with a decorative fabric.

The canvas (or other appropriate material) tubular section 12 covers the frame 11 providing that the frame 11 maintains the bag in an "open" configuration for receiving large items such as helmets and catchers gear.

FIG. 1 shows the bag 10 with one or more pouches 22 (two are shown) secured (sewn) on the exterior surface of the bag 10 for storing miscellaneous items. A pouch may be closed by a zipper 24 or provided with a cover flap 26 that is closed by hook and eye material such as VELCRO™.

FIG. 1 shows a bag 30 used for storing bats and having apertures 28 (two are shown) at the top of the bat bag which engage hooks on equipment bag 10. An elastomeric strap 32 around the lower end of the bat bag 30 holds the bats securely in place inside bag 30 against the bag 10.

Figure 3:
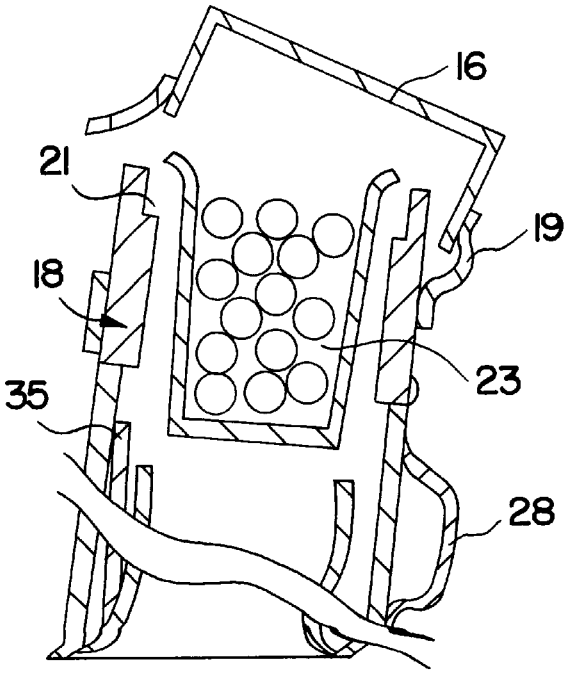
FIG. 3 is a sectional view showing how a bucket of balls are transported.

FIG. 3 is a sectional view showing details of the top collar 18, and lid 16. The lid 16 is hinged by a strap 19 to the collar 18. The collar 18 has an internal shoulder 21 providing that a bucket of balls 23 may be supported by a lip 23A of the bucket 23 on the shoulder 21 and stored inside the bag for transportation then withdrawn from the bag 10 as a whole bucket of balls when needed. The lid 16 closes down over the bucket 23 thereby retaining retain the balls in the enclosed position when required.

FIG. 3 also shows a pair of elongated pouches 33 mounted on the inside surface of bag 10 for storing catchers shin guards, FIG. 3 shows two pouches 33 for shinguards. One shinguard 35 is shown.

Helmets and catcher's protective gear (not shown) are stored in the region between the bottom of the bucket 23 and the cap 14.

FIG. 1 also shows a handle 28 mounted on the outside of the bag 10 so that, when the bag 10 is loaded, the bag 10 may be carried by the handle 29.

Figure 4:
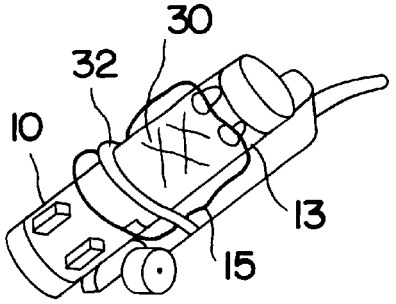
FIG. 4 shows the bag being transported on a golf cart.

FIG. 4 shows the bag 10 secured and carried on a golf cart 15. FIG. 4. also shows the strap 32 engaging the cart 15.

Modifications and variations of the utility bag for baseball/softball may be suggested by studying the drawings and reading the specification that are within the scope of the invention. I therefore wish to define the scope of the invention by the appended claims.

I claim:

1. A utility bag for storing and transporting the equipment of a baseball and softball teams which comprises:

an elongated flexible tubular section;

a cap enclosing a bottom end of said tubular section;

a collar secured around a periphery of a top open end of said tubular section;

a removable lid means engagable with said collar for enclosing said open end;

a bucket (23) having a lip (23A);

said collar having an internal shoulder (21) around a top inside edge of said collar engagable with said lip providing that when said bucket is supported inside said collar and items are stored in said bucket and said lid is closed against said collar, said items are secured in said container;

said flexible tube having a length of space between said bottom end of said flexible tube and a bottom of said bucket supported on said shoulder to permit storing shinguards in said space.

2. The utility bag of claim 1 which further comprises means for detachably attaching said bag to a golf cart.

3. The utility bag of claim 1 wherein said lid comprises:

a cylinder with one end open and another end having a cover;

said cylinder and cover being made of a semirigid sheet;

said cylinder having an inside diameter selected to engage an outside diameter of said collar.

4. The utility bag of claim 3 wherein said lid further comprises a hinge means for permitting said lid to be rotated to an open position to open said bag and remove said bucket of balls and to a closed position where said bucket of balls is secured inside said bag.

5. The utility bag of claim 4 wherein said hinge means comprises a flap having one end secured to said cap and another end secured to an outside surface of said collar.

6. The utility bag of claim 1 wherein said collar has a diameter selected to permit passing a helmet through said collar and said bag has dimensions between said collar and said cap selected to permit storing a plurality of helmets and catchers gear.

7. The utility bag of claim 1 which comprises:

a bat bag having dimensions selected for storing at least one bat;

means for detachably attaching said at least one bat bag for storing bats to an outside surface of said bag.

8. The utility bag of claim 7 wherein said means for detachably attaching said bat bag comprises;

at least one S-hooksecured to said outside surface of said bag;

at least one D-aperture ring secured to said outside surface of said utility bag;

each one of said at least one S-hook configured to engage a respective one of said D apertures providing that said bats in said bat bag are storable with said utility bag.

9. The utility bag of claim 8 which comprises a strap arrange to engage a golf cart and said utility bag and said bat bag when said utility bag is positioned on said golf cart.

10. The utility bag of claim 1 wherein said flexible tubular section is made of a material selected from a group of materials that consists of canvas and decorative fabric.

11. The utility bag of claim 1 which comprises a plurality of rigid rods inside said bag, each rod having one end engaging said cap and another end engaging said collar whereby said plurality of rods provide a frame that maintains said bags in an open configuration.

12. The utility bag of claim 1 comprising;

at least one pouch secured to an outside surface of said flexible tubular section;

each one of said at least one pouch having an opening that is closable by one of a zipper and a flap of hook and eye material.

13. The utility bag of claim 1 which comprises:

at least one pouch secured to an inside surface of said bag 10;

said at least one pouch operably dimensioned for storing at least one shin guard.

14. The utility bag of claim 1 which further comprises a cart means for transporting said bag.

15. The utility bag of claim 14 wherein said cart means is a golf cart.

16. A utility bag for storing and transporting the equipment of a baseball and softball teams which comprises:

an elongated flexible tubular section (12);

a cap (14) enclosing a bottom end of said tubular section;

a collar (18) secured around a periphery of a top open end of said tubular section and having a diameter selected to permit passing a helmet through said collar into said bag;

a lid (16) for enclosing said top open end;

a bucket (23) having a lip (23A);

said collar having an internal shoulder (21) around a top inside edge of said collar engagable with said lip providing that when said bucket is supported inside said collar and items are stored in said bucket and said lid is closed against said collar, said items are secured in said container;

a hinge coupling an edge of said lid to an upper end of said flexible tube arranged to permit rotating said lid to an open position to open said bag and remove said bucket and to a closed position where said bucket is secured inside said bag;

said flexible tube having a length of space between said bottom end of said flexible tube and a bottom of said bucket supported on said shoulder to permit storing shinguards in said space;

a plurality of rigid rods inside said bag, each rod having one end engaging said cap and another end engaging said collar whereby said plurality of rods provide a frame that maintains said bags in an open configuration and supports said bag in an upright orientation;

at least one bat bag dimensioned for storing bats each at least one bat bag having at least one S-hook secured to said outside surface of said bag;

at least one D-aperture ring secured to an outside surface of said utility bag configured to engage a respective one of said at least one S hook providing that said bats in said bat bag are storable with said utility bag a strap arranged to detachably secure said utility bag to a golf cart.

* * * * *